US007068141B2

(12) United States Patent
Senda et al.

(10) Patent No.: US 7,068,141 B2
(45) Date of Patent: Jun. 27, 2006

(54) THERMAL FUSE

(75) Inventors: Kenji Senda, Fukui (JP); Atsushi Kono, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/468,357

(22) PCT Filed: Feb. 20, 2002

(86) PCT No.: PCT/JP02/01443

§ 371 (c)(1),
(2), (4) Date: Aug. 19, 2003

(87) PCT Pub. No.: WO02/067282

PCT Pub. Date: Aug. 29, 2002

(65) Prior Publication Data

US 2004/0070486 A1 Apr. 15, 2004

(30) Foreign Application Priority Data

Feb. 20, 2001 (JP) ..... 2001-043022

(51) Int. Cl.
*H01H 85/08* (2006.01)
*H01H 85/055* (2006.01)

(52) U.S. Cl. ..... 337/405; 337/404; 337/416; 337/290

(58) Field of Classification Search ..... 337/404, 337/405, 414, 416, 159, 163, 186, 187, 227, 337/290, 295, 297; 29/623
See application file for complete search history.

(56) References Cited

U.S. PATENT DOCUMENTS 5,140,295 A * 8/1992 Vermot-gaud et al. ..... 337/297
5,712,610 A * 1/1998 Takeichi et al. ..... 337/290
5,982,268 A * 11/1999 Kawanishi ..... 337/297
6,040,754 A 3/2000 Kawanishi
6,222,438 B1 * 4/2001 Horibe et al. ..... 337/290
6,384,708 B1 * 5/2002 Jollenbeck et al. ..... 337/297
6,556,122 B1 * 4/2003 Izaki et al. ..... 337/405

FOREIGN PATENT DOCUMENTS

| | | | |
|---|---|---|---|
| EP | 0 964 419 | | 12/1999 |
| JP | 7-201265 | | 8/1995 |
| JP | 11-16466 | | 1/1999 |
| JP | 11-353996 | | 12/1999 |
| JP | 2000-348583 | | 12/2000 |
| JP | 2001006508 | A * | 1/2001 |
| JP | 2001283697 | A * | 10/2001 |
| JP | 2001297672 | A * | 10/2001 |
| JP | 2002150908 | A * | 5/2002 |
| JP | 2002184279 | A * | 6/2002 |
| JP | 2003331704 | A * | 11/2003 |

OTHER PUBLICATIONS

Patent Abstractsof Japan, vol. 2000, No. 2, Feb. 29, 2000, & JP 11 306940 (NEC Kansai Ltd.). Nov. 5, 1999.
Patent Abstracts of Japan, vol. 2000, No. 5, Sep. 14, 2000, & JP 2000 048696 A (Matsushita Electric Industrial Co., Ltd.), Feb. 18, 2000.

* cited by examiner

*Primary Examiner*—Anatoly Vortman
(74) *Attorney, Agent, or Firm*—Wenderoth, Lind & Ponack, L.L.P.

(57) ABSTRACT

A thermal fuse having a quick melting property is provided. In the thermal fuse, metal layers 15, 16 connected to a fusible alloy 13 are provided at respective leading ends of a pair of metal terminals 11. The metal layers 15, 16 have larger wettability to a fusible alloy 13 than wettability of metal terminals 11 and first insulating film 12. The area (S) of the metal layers 15, 16, the length (L1) and the volume (V) of the fusible alloy 13, the distance (L2) between the leading ends of the metal terminals 11, and the distance (d) from the bottom face of the second insulating film 14 to the top face of the metal layers 15,16 satisfy the relation of Sd>V(L1+L2)/2L1.

10 Claims, 6 Drawing Sheets

FIG. 5A – PRIOR ART
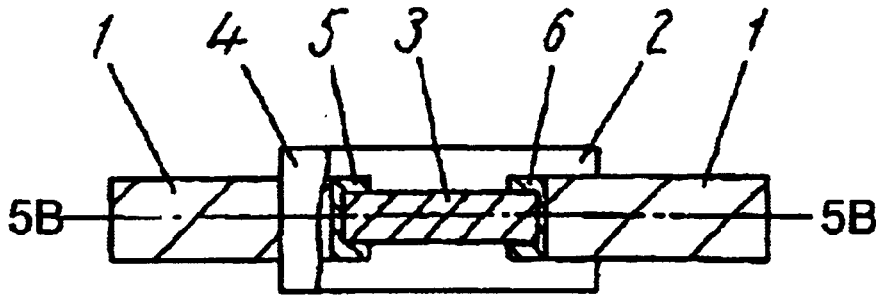
FIG. 5B – PRIOR ART
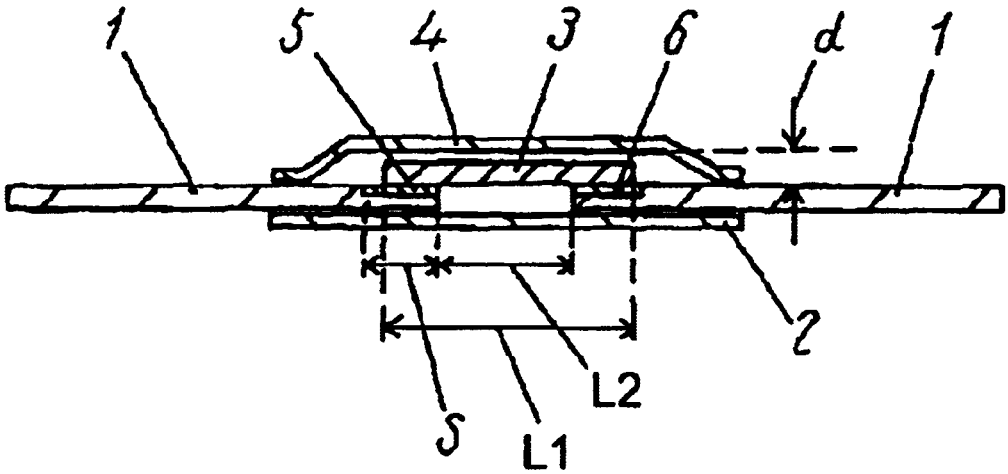

FIG. 6A – PRIOR ART
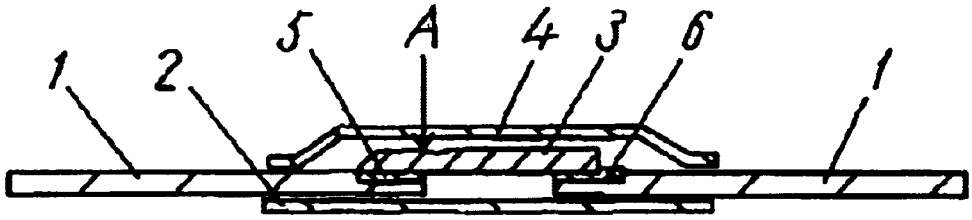
FIG. 6B – PRIOR ART
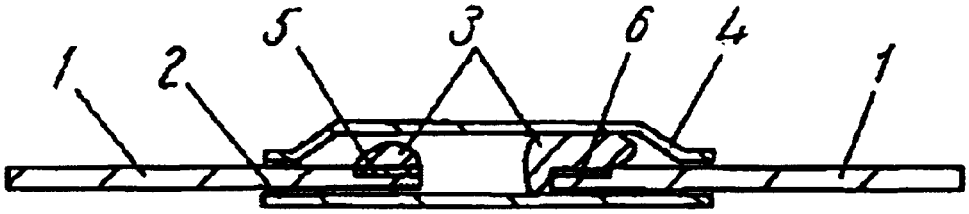

THERMAL FUSE

TECHNICAL FIELD

The present invention relates to a thermal fuse.

BACKGROUND ART

Electronic appliances have recently undergone progressive size reductions. For example, a conventional battery pack of a portable telephone had a thickness ranging from 5 mm to 6 mm, but has recently been required to have a thickness ranging 2.5 mm to 4 mm. The electronic appliance is becoming smaller, and its thermal capacity accordingly becomes smaller, and an increase in the speed of heat generation accordingly becomes larger. This situation requires a quick-melting property for thermal fuses used for such protective purpose.

FIG. 5A is a partially cut-away top view of a conventional thermal fuse, and FIG. 5B is a sectional view of the fuse along line 5B—5B in FIG. 5A.

As shown in FIG. 5A and FIG. 5B, the conventional thermal fuse includes a first insulating film 2 having respective leading ends of a pair of metal terminals 1 provided on a top face of the film 2, a fusible alloy 3 provided over the first insulating film 2 and between the leading ends of the metal terminals 1, a second insulating film 4 provided over the fusible alloy 3 and affixed to the first insulating film 2 and metal terminals 1, and metal layers 5, 6 provided on the leading ends of the pair of metal terminals 1 and connected to the fusible alloy 3. The metal layers have larger wettability to the fusible alloy 3 than the metal terminals 1 and first insulating film 2.

The area of the metal layers 5, 6 is S, the length and volume of the fusible alloy 3 are L1 and V, respectively, the distance between the leading ends of the pair of metal terminals 1 is L2, and the distance from the bottom face of the second insulating film 4 to the top face of the metal layers 5, 6 is d.

FIG. 6A and FIG. 6B show the metal terminals 1 which are heated.

First, the fusible alloy 3 is heated to over its melting point and melts, and as shown in FIG. 6A, the fusible metal 3 is then divided into parts (point A in the figure) of the fusible alloy 3. Then, as shown in FIG. 6B, the temperature of the entire thermal fuse exceeds the melting point of the fusible alloy 3, and the fusible alloy 3 melts. Then, the melting fusible alloy 3 moves onto the metal layers 5, 6 having a large wettability connected to the metal terminals 1. As a result, a volume V(L1+L2)/2L1 including a volume V(L2/L1) between the metal terminals 1 and a volume V(L1−L2)/2L1 on the metal layers 5, 6 out of the volume V of the fusible alloy 3 moves onto the metal layers 5, 6.

As batteries become smaller, it is necessary for the thermal fuse to be smaller and thinner.

In order to reduce the size and thickness of the conventional thermal fuse, the fusible alloy 3 may have its size reduced. Accordingly, the fusible alloy 3 generates heat by its resistance due to an increase of a current passing the alloy, and melts down by the heat. Hence, the fusible alloy 3 cannot have the reduced size. The distance L2 between the leading ends of the metal terminals 1 cannot be reduced too much in order to ensure cut off of the current during the operation of the thermal fuse. As a result, in the conventional thermal fuse, since a volume Sd enclosed by the metal layers 5, 6 and the second insulating film 4 is small, the volume V(L1+L2)/2L1 of the fusible alloy 3 moving to the metal layer 5 or the metal layer 6 exceeds the volume Sd. Then, as shown in FIG. 6B, the fusible alloy 3 overflows to the metal terminals 1 or first insulating film 2 from above the metal layers 5, 6. In this case, since the wettability of the metal terminals 1 and first insulating film 2 on the fusible alloy 3 is smaller than that of the metal layers 5, 6, the fusible alloy 3 moves slowly during its melt-down, and the separation of the fusible alloy 3 during the melt-down is delayed, that is, the thermal fuse does not melt down quickly.

SUMMARY OF THE INVENTION

A thermal fuse includes a pair of metal terminals, a first insulating film having respective leading ends of the metal terminals provided on the insulating film, a fusible all provided between the leading ends of the metal terminals, a second insulating film provided over the fusible alloy and affixed to the first insulating film, and metal layers to which the fusible alloy is connected. The metal layers are provided at the leading ends of the metal terminals, respectively, and have larger wettability to the fusible alloy than the metal terminals and the first insulating film. The area (S) of the metal layers, the length (L1) and volume (V) of the fusible alloy, the distance (L2) between the leading ends of the metal terminals, and the distance (d) from he bottom face of the second insulating film to the top face of the metal layers satisfy the following relation:

$$Sd > V(L1+L2)/2L1.$$

In this thermal fuse, since the fusible alloy after melting is entirely contained on the metal layers having high wettability to the fusible alloy, the fusible alloy does not overflow onto the metal terminals or first insulating film having a wettability to the fusible metal smaller than that of each metal layer. As a result, the fusible metal is divided quickly.

BRIEF DESCRIPTION OF THE DRAWINGS

FIG. 5A is a partially cut-away top view of a conventional thermal fuse.

FIG. 5B is a sectional view along line 5B—5B of the thermal fuse shown in FIG. 5A.

FIG. 6A and FIG. 6B are sectional views of essential parts of the conventional thermal fuse showing heated metal terminals.

DETAILED DESCRIPTION OF PREFERRED EMBODIMENTS (Embodiment 1)

Figure 1A:
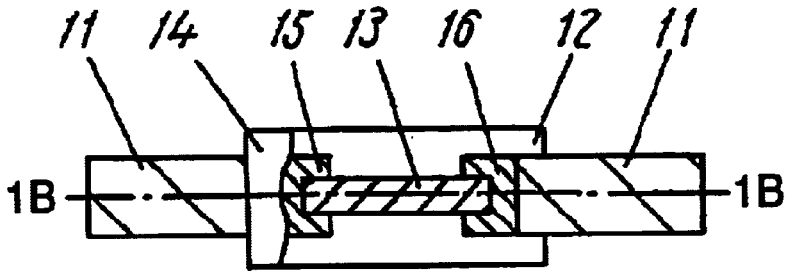
FIG. 1A is a partially cut-away top view of a thermal fuse according to exemplary embodiment 1 of the present invention.
Figure 1B:
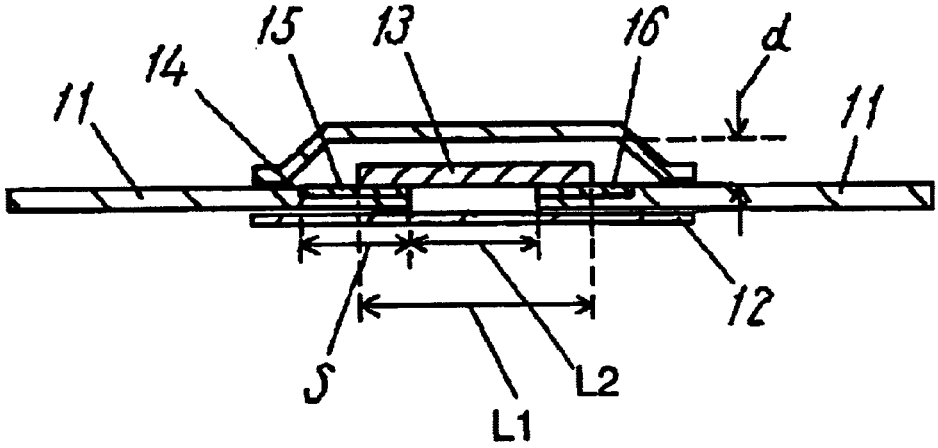
FIG. 1B is a sectional view along line 1B—1B of the thermal fuse shown in FIG. 1A.

FIG. 1A is a partially cut-away top view of a thermal fuse according to exemplary embodiment 1 of the present invention. FIG. 1B is a sectional view along line 1B—1B of the thermal fuse shown in FIG. 1A.

The thermal fuse according to embodiment 1 includes a first insulating film 12 having respective leading ends of a pair of metal terminals 11 on the top face of the film 12, a fusible alloy 13 provided over the first insulating film 12 and between the leading ends of the metal terminals 11, and a second insulating film 14 provided over the fusible alloy 13 and affixed to the first insulating film 12 and metal terminals 11. Metal layers 15, 16 provided at the leading ends of the pair of metal terminals 11 have larger wettability to the fusible alloy 13 than the metal terminals 11 and first insulating film 12, and are connected to the fusible alloy 13.

The area (S) of the metal layers 15, 16, the length (L1) and volume (V) of the fusible alloy 13, the distance (L2) between the leading ends of the pair of metal terminals 11, and the distance (d) from the bottom face of the second insulating film 14 to the top face of the metal layers 15, 16 satisfy the relation of $Sd>V(L1+L2)/2L1$. If the length (a) of a main body of the thermal fuse including the first insulating film 12, second insulating film 14, and fusible alloy 13 is 2.0 mm or less, the distance L2 between the leading ends of the pair of metal terminals 11 is 0.5 mm or less in order to fabricate the thermal fuse. In this case, if the distance (L2) is less than 0.5 mm, burrs may be formed in the fabrication of the metal terminals 11, or metal particles may be created by the burrs. Then, foreign matter, such as the burrs or the metal particles may prevent the fuse from having a sufficient insulation between the pair of metal terminals 11 after operating, and it is not practical for the thermal fuse. If the length (a) of the main body is more than 5.0 mm, the fuse requires a large area for its installation in a small battery, and it is not practical. Therefore, the length (a) of the main body of the thermal fuse ranges preferably from 2.0 mm to 5.0 mm.

The pair of metal terminals 11 are flat or linear, and are mainly composed of metal essentially containing nickel, nickel alloy, such as copper nickel, nickel alone, or nickel alloy combined with another element.

If the metal terminals 11 are made of material containing 98% or more of nickel, the fuse has remarkably-increased reliability, such as corrosion resistance, since the material has a small electrical resistivity ranging from $6.8\times10^{-8}$ to $12\times10^{-8}$ Ω·m.

A thickness of the metal terminal 11 ranging from 0.08 mm to 0.25 mm allows the fuse to have an excellent performance and to be handled easily. If the thickness of the metal terminal 11 is less than 0.08 mm, the metal terminal has a large electrical resistance and a small mechanical strength, and thus can be bent accidentally or may cause other problems during handling. If the thickness exceeds 0.25 mm, the thickness of the thermal fuse itself increases, and it is not suited to small-size appliances.

If the metal terminals 11 are made of material having a Young's modulus ranging from $3\times10^{10}$ to $8\times10^{10}$ Pa and a tensile strength ranging from $4\times10^{8}$ to $6\times10^{8}$ Pa, the terminals are prevented from being bent accidentally during handling or transportation. Further, the terminals can be bent easily, and do not suffer from wire breakage and other troubles problems during bending. If the Young's modulus of the metal terminals 11 is less than $3\times10^{10}$ Pa, the terminals can be bent very easily, and an undesired portion of the terminals (such as electrical connection parts at end portions of metal terminals 11) may be bent and undulated, thus preventing connection by welding. If the Young's modulus of the metal terminals 11 is more than $8\times10^{10}$ Pa, the terminals can hardly be bent at a desired portion of the terminals, or may be broken. If the tensile strength of metal terminals 11 is less than $4\times10^{8}$ Pa, the terminals are bent too easily. If the strength is more than $6\times10^{8}$ Pa, the terminals can hardly be bent at a desired portion of the terminal, or may be broken.

The metal layers 15, 16 provided on the top faces of the leading ends of the metal terminals 11 are mainly composed of metal, such as tin, copper, tin alloy, or copper alloy which have large wettability to the fusible alloy 13. The fusible alloy 13 is connected to the metal layers 15, 16.

The wettability to the fusible alloy 13 of tin or copper for composing the metal layers 15, 16 is larger than that of nickel for composing the metal terminals 11. Accordingly, the metal layers 15, 16 composed of tin, copper, tin alloy, or copper alloy transfer the fusible alloy 13 toward the metal layers 15, 16 after melt-down, thus allowing the fusible alloy 13 to be divided quickly.

The material of the metal layers 15, 16 may be bismuth, indium, or cadmium either alone or as an alloy aside from tin and copper. The thickness of the metal layers 15, 16 is preferably 15 μm or less. If the thickness of the metal layers 15, 16 is more than 15 μm, the metal of the metal layers 15, 16 is diffused into the fusible alloy 13 too much. The melting point of the fusible alloy 13 varies accordingly, and a working temperature of the thermal fuse fluctuates accordingly. The metal layers 15, 16, upon being made of an alloy of the same composition as the fusible alloy 13, do not change the melting point of the alloy 13 even when metal composing the metal layers 15,16 is diffused into the fusible alloy 13, thus providing a thermal fuse having a precise working temperature.

The first insulating film 12 is shaped like a sheet, and the respective leading ends of the pair of metal terminals 11 are located at a specific interval on the top face of the film 12. The first insulating film 12 may be made of resin (preferably thermoplastic resin) mainly composed of one of polyethylene terephthalate (PET), polyethylene naphthalate (PEN), ABS resin, SAN resin, polysulphone resin, polycarbonate resin, noryl, vinyl chloride resin, polyethylene resin, polyester resin, polypropylene resin, polyamide resin, PPS resin, polyacetal, fluoroplastic, and polyester.

The first insulating film 12 is not limited to having a single-layer structure, and may be formed by stacked sheets of different materials. For example, a film made of PET and a film made of PEN stacked increases the strength of the first insulating film 12, thus increasing the mechanical strength of the fuse. Further, a PEN sheet improves the heat resistance of the insulating film, thus providing a thermal fuse usable at a temperature higher than 130° C. Having the laminated structure, the first insulating film 12 may be fabricated with a combination of material having a low heat resistance and material having a high heat resistance, aside from the combination of materials mentioned above The fusible alloy 13 is shaped in a linear form having a rectangular section or circular section, and is cut to have a proper length. The alloy 13 is then provided to bridge between the respective leading ends of the pair of metal terminals 11 over the central part of the top face of the first insulating film 12. The fusible alloy 13 may be shaped in the linear form by a die drawing process or a die extrusion process. A linear fusible alloy having a circular section, being compressed, provides a linear fusible alloy having a rectangular section. The metal layers 15, 16 and the fusible alloy 13 provided over the top face of the metal terminals 11 are connected by laser welding, thermal welding, ultrasonic welding or the like. The laser welding reduces a heat generation area, thus allowing the fusible alloy 13 to be connected to the metal layers 15, 16 without causing any damage to any area other than a welded area of the fusible alloy 13.

The fusible alloy 13 is made of an alloy of metal, such as tin, lead, bismuth, indium, or cadmium, having a melting point less than 200° C., and is made preferably of a eutectic alloy. The alloy provides a thermal fuse having a working temperature which does not fluctuate since the fusible alloy 13 has a difference of about 0° C. between its solid phase temperature and its liquid phase temperature and does not have a solid-liquid mixed temperature region. For example, a eutectic alloy composed of 18.75 wt. % of tin, 31.25 wt. % of lead, and 50.0 wt. % of bismuth has a melting point (liquid phase temperature and solid phase temperature) of 97° C. This eutectic alloy, therefore, provides the thermal fuse with a working temperature ranging from 97 to 99° C. Here, the melting point of the fusible alloy 13 and the working temperature of the thermal fuse are different since there is a temperature difference ranging from about 1 to 2° C. between an ambient temperature and the temperature of the fusible alloy 13 in the case that a conductivity for heat from the outer side of the thermal fuse to the fusible alloy 13 is small.

The fusible alloy 13 may be made of an alloy having a composition of component metals deviated by 0.5 to 10 wt. % from the composition of eutectic alloy. Such alloy has a higher melting point (liquid phase temperature) than the eutectic alloy by one to more than 10° C., thus providing a thermal fuse having a working temperature higher than a fuse using the eutectic alloy. The alloy has the composition close to that of the eutectic alloy, thus having a small difference between its solid phase temperature and its liquid phase temperature. Moreover, since having a small solid-liquid mixed temperature, the thermal fuse has suppressed fluctuations of its working temperature. For example, an alloy containing 20 wt. % of tin, 25 wt. % of lead, and 55 wt. % of bismuth (this alloy has a composition deviating from a eutectic alloy by +1.25 wt. % of tin, −6.25 wt. % of lead, and +50 wt. % of bismuth) has a melting point (liquid phase temperature) of 101° C., thus providing a thermal fuse having a working temperature ranging from 101° C. to 103° C.

The fusible alloy 13 may be made of an alloy composed of a eutectic alloy and 0.5 wt. % to 10 wt. % of metal not contained in the eutectic alloy. Such alloy has a lower melting point than the eutectic alloy by one to more than 10° C., thus providing a thermal fuse having a working temperature lower than that of a fuse using the original eutectic alloy. Such alloy has a small difference between its solid phase temperature and its liquid phase temperature. Moreover, since having a small solid-liquid mixed temperature region, the thermal fuse has a suppressed fluctuation of its working temperature. For example, an alloy containing 7% of indium and a eutectic alloy consisting of 18.75 wt. % of tin, 31.25 wt. % of lead, and 50.0 wt. % of bismuth has a melting point (liquid phase temperature) of 82° C., thus providing a thermal fuse having a working temperature ranging from 82° C. to 84° C.

Figure 2A:
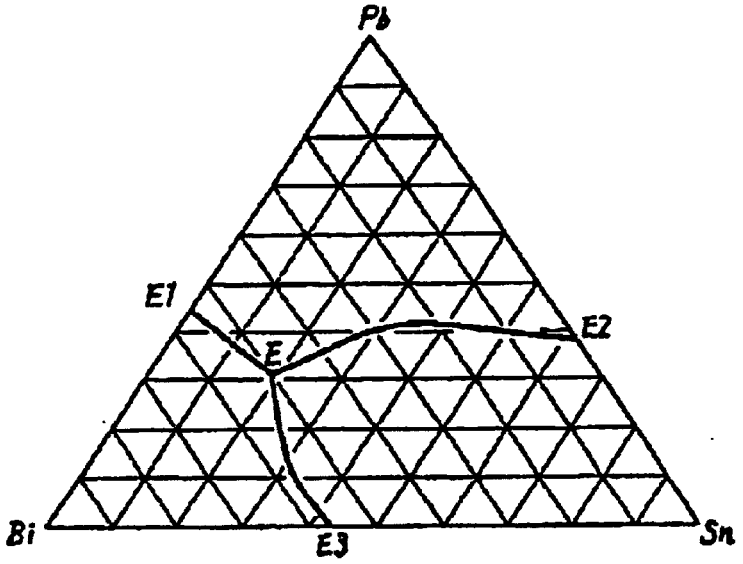
FIG. 2A is a correlation diagram of three-element alloy composed of tin, lead, and bismuth.
Figure 2B:
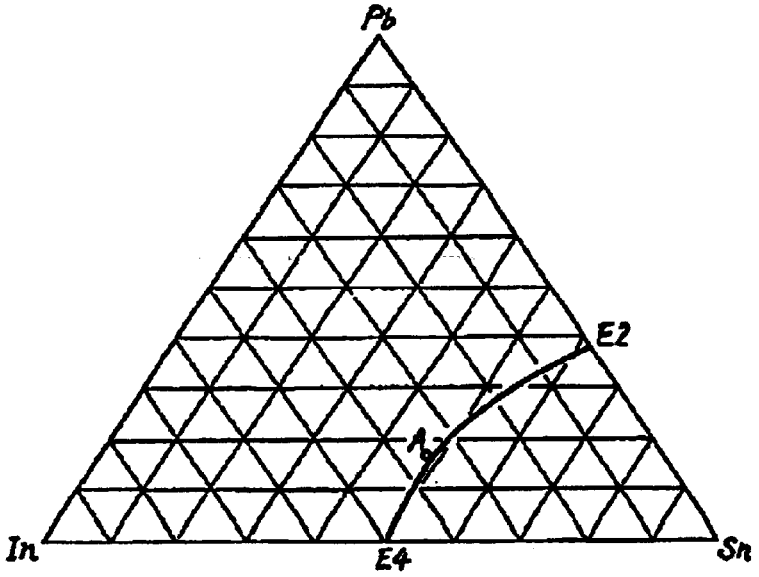
FIG. 2B is a correlation diagram of three-element alloy composed of tin, lead, and indium.

An alloy having three or more elements has a specific composition in which all metals but one crystallize simultaneously at its liquid phase temperature when being cooled after melting. This composition of the three-element alloy is expressed by a line linking eutectic points of two elements out of the eutectic point of a three-element alloy. The line is simply called a eutectic line herein. FIG. 2A is a correlation diagram of a three-element alloy composed of tin, lead, and bismuth, and FIG. 2B is a correlation diagram of a three-element alloy composed of tin, lead, and indium. Point E is a three-element eutectic point, point E1 is a lead-bismuth eutectic point, point E2 is a tin-lead eutectic point, and point E3 is a tin-bismuth eutectic point. Curves E-E1, E-E2, and E-E3 are eutectic lines. The alloy of tin, lead, and indium has only a eutectic line of curve E2–E4 since an eutectic point does not exist in the lead-indium alloy. A composition on this eutectic line or close to the eutectic line is relatively small in the solid phase temperature and liquid phase temperature. The fusible alloy 13, using such alloy, provides a thermal fuse having a working temperature fluctuating relatively little. The alloy corresponds to point A in FIG. 2B. An alloy composed of 43% of tin, 10.5% of lead, and 46.5% of indium has a melting point (liquid phase temperature) of 129° C., thus providing a thermal fuse having a working temperature ranging from 129° C. to 131° C.

A periphery of the fusible alloy 13 is coated with flux (not shown) mainly composed of rosin. This flux (not shown) may be the same material as used in soldering or metal welding.

The second insulating film 14 shaped like a sheet is located over the fusible alloy 13 so as to cover the fusible alloy 13, and is affixed to the first insulating film 12 and metal terminals 11 on the periphery of the fusible alloy 13. Thus, the fusible alloy 13 is enclosed with the first insulating film 12 and second insulating film 14. Further, the first insulating film 12, metal terminals 11, and second insulating film 14 are affixed, thereby allowing the fusible alloy 13 to be tightly enclosed and preventing the alloy 13 from deteriorating.

The second insulating film 14 is preferably made of the same material as the first insulating film 12, such as resin (preferably thermoplastic resin) mainly composed of one of PET, PEN, ABS resin, SAN resin, polysulphone resin, polycarbonate resin, noryl, vinyl chloride resin, polyethylene resin, polyester resin, polypropylene resin, polyamide resin, PPS resin, polyacetal, fluoroplastic, and polyester.

The second insulating film 14 is not limited to having a single-layer structure, but may have a laminated sheet of different materials. For example, a laminated film including a film made of PET and a film made of PEN increases the strength of the second insulating film 14, thus increasing the mechanical strength of the fuse. A PEN sheet increases a heat resistance, thus, providing a thermal fuse usable at a temperature higher than 130° C. The second insulating film 14, having a laminated structure, may be made of a combination of a material having a small heat resistance and a material having a large heat resistance aside from the combination of materials mentioned above.

Figure 3:
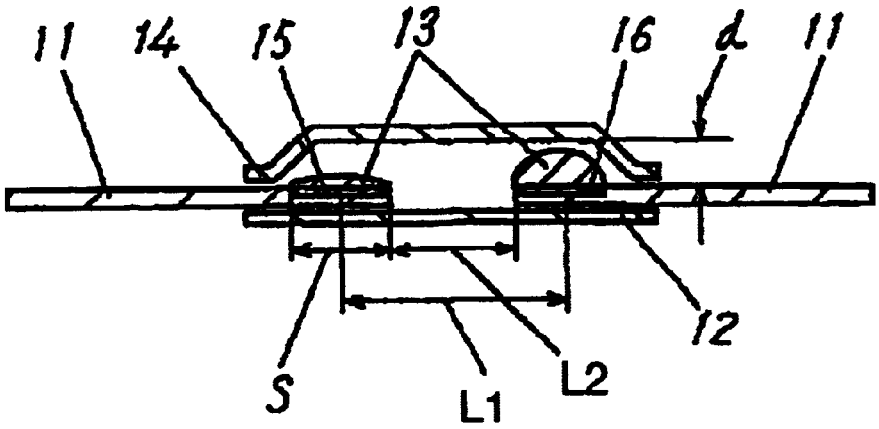
FIG. 3 is a sectional view of an essential part of the thermal fuse according to embodiment 1, showing a fusible alloy melting due to heat applied to a metal terminal.

FIG. 3 is a sectional view of the fusible alloy 13 which melts due to heat applied to the metal terminal 11 of the thermal fuse of embodiment 1 of the invention.

As shown in FIG. 3, in the thermal fuse of embodiment 1, at most, a total volume V(L1+L2)/2L1 of the volume V(L2/L1) of a portion of the fusible alloy 13 between the metal terminals 11 and the volume V(L1−L2)/2L1 of a portion of the fusible alloy 13 at the heated side of the metal terminal 11, i.e., one of the metal layers 15, 16 (only the metal layer 15 is shown in FIG. 3) moves onto the metal layer 15. Since the volume V(L1+L2)/2L1 of the fusible alloy is smaller than the volume Sd enclosed by the metal layer 15 and the second insulating film 14 over the metal layer 15, the melting fusible alloy 13 is all settled on the metal layer 15 having large wettability to the fusible alloy 13. Therefore, the fusible alloy 13 does not overflow onto the metal terminals 11 and first insulating film 12 having a smaller wettability to the fusible alloy 13 than the metal layer 15. As a result, the fusible alloy 13 is divided quickly, thus providing the thermal fuse having a quick melting property.

Comparison of respective quick melting properties of the conventional thermal fuse and the thermal fuse of embodiment 1 will be described below.

As the thermal fuse of embodiment 1 (hereinafter "sample of the embodiment"), 50 (fifty) samples each including the fusible alloy 13 having a melting point of 97° C. have dimensions of d=0.3 mm, S=3.6 $mm^2$, V=0.95 $mm^3$, L1=2.7 mm, and L2=1.6 mm. Each sample of the embodiment measures Sd=1.08 $mm^3$, and V(L1+L2)/2L1=0.756481 $mm^3$, which satisfies the relation of Sd>V(L1+L2)/2L1. If the distance (b) from the bottom face of the first insulating film 12 to the top face of the second insulating film 14 satisfies b<0.3 mm, the distance does not provides enough space for accommodating the fusible alloy 13, thus not providing a thermal fuse. A small battery includes a protrusion, for example, an electrode having a height ranging generally from 0.5 to 0.7 mm. Therefore, if b>0.7 mm, the distance prevents a battery from being small since the thermal fuse becomes thick for the small battery. The thermal fuses including main bodies each including the first insulating film 12, second insulating film 14, and fusible alloy 13 were fabricated in the measurement of length (a) of 4.0 mm and distance (b) of 0.6 mm.

As comparative samples, 50 (fifty) comparative samples in which d=0.25 mm, S=1.6 $mm^2$, V=0.95 $mm^3$, L1=2.7 mm, and L2=1.6 mm were prepared, and 50 (fifty) conventional thermal fuses were fabricated in conditions otherwise the same as those of the samples of the embodiment. The comparative samples have Sd=0.4 $mm^3$ and V(L1+L2)/2L1=0.756481 $mm^3$, which does not satisfy the relation of Sd>V(L1+L2)/2L1.

The surface temperature of a heat generating device was set at 120° C. When the temperature of the heat generating device was sufficiently stabilized, one terminal of each sample tightly contacts the heat generating device, and then, the time from the contact until melt-down of the thermal fuse was measured. Results are shown in Table 1.

TABLE 1

| | Melt-Down Time (seconds) | | |
|---|---|---|---|
| | Average | Maximum | Minimum |
| Embodiment 1 | 11.35 | 14.3 | 7.6 |
| Comparative Example | 44.23 | 52.4 | 30.6 |

As shown in Table 1, the samples of the embodiment melt down in 7 seconds to 14 seconds, while the comparative samples melt down in 30 seconds to 52 seconds. This shows that the thermal fuse of embodiment 1 of the invention is superior in the quick melting property.

(Embodiment 2)

Figure 4A:
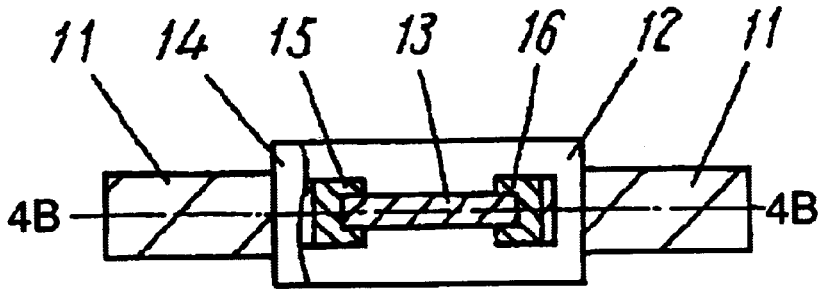
FIG. 4A is a partially cut-away top view of a thermal fuse according to exemplary embodiment 2 of the invention.
Figure 4B:
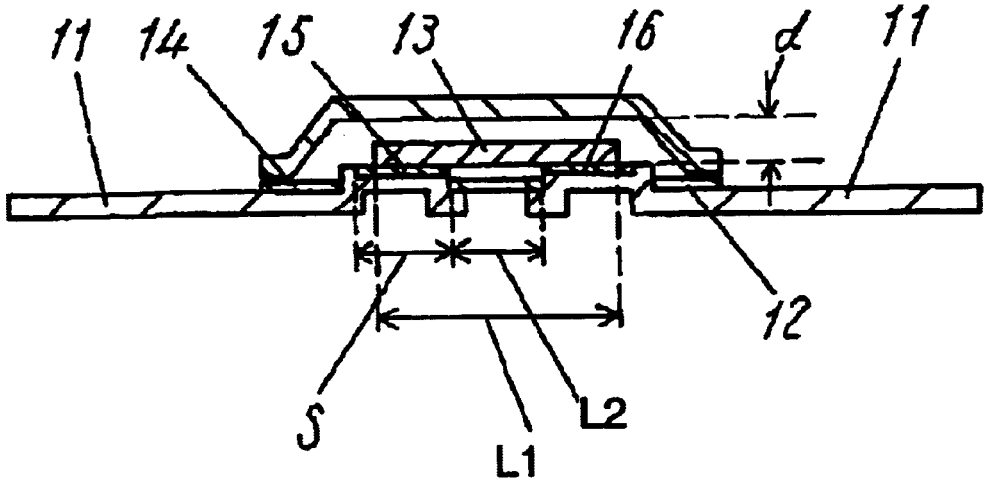
FIG. 4B is a sectional view along line 4B—4B of the thermal fuse shown in FIG. 4A.

FIG. 4A is a partially cut-away top view of a thermal fuse according to exemplary embodiment 2 of the present invention, and FIG. 4B is a sectional view along line 4B–4B of the thermal fuse shown in FIG. 4A.

Parts in embodiment 2 that are same as parts of embodiment 1 are denoted by the same reference numerals, and their description is omitted.

As shown in FIG. 4A, differently from embodiment 1, respective leading ends of a pair of metal terminals 11 are disposed at the bottom face of the first insulating film 12 and exposed from the top face of the first insulating film 12, and metal layers 15, 16 having a large wettability are provided at least in a portion of the exposed portions of the terminals.

In the thermal fuse of embodiment 2, the metal layers 15, 16 having a wettability larger than wettabilities of the metal terminals 11 and first insulating film 12 are provided at portions or the whole of the exposed portions of the metal terminals 11. The area (S) of the metal layers 15, 16, the length (L1) and the volume (V) of the fusible alloy 13, the distance (L2) between the leading ends of the pair of metal terminals 11, and the distance (d) from the bottom face of the second insulating film 14 to the top face of the metal layers 15, 16 satisfy the relation of Sd>V(L1+L2)/2L1. Accordingly, in the fuse, all of the melting fusible alloy 13 is settled at least on one of the metal layers 15 and 16 having a large wettability to the fusible alloy 13. Therefore, the fusible alloy 13 does not overflow onto the metal terminals 11 and first insulating film 12 having a smaller wettability to the fusible alloy 13 than the metal layers 15, 16. As a result, the fusible alloy 13 is divided quickly, thus providing a thermal fuse having a quick melting property.

INDUSTRIAL APPLICABILITY

In a thermal fuse according to the invention, metal layers connected to a fusible alloy are provided at respective leading ends of a pair of metal terminals. The metal layers have larger wettability to the fusible alloy than the metal terminals and a first insulating film. The area (S) of the metal layers, the length (L1) and the volume (V) of the fusible alloy, the distance (L2) between the leading ends of the metal terminals, and the distance (d) from the bottom face of the second insulating film to the top face of the metal layers satisfy the relation of Sd>V(L1+L2)/2L1. Accordingly, all of fusible alloy after melting is settled on the metal layers having the large wettability to the fusible alloy, and as a result, the fusible alloy does not overflow onto the metal terminals or first insulating film having a smaller (lower) wettability to the fusible alloy than the metal layers. Therefore, the fusible alloy is divided quickly, thus providing a thermal fuse having a quick melting property.

What is claimed is:

1. A thermal fuse comprising:

a pair of metal terminals;

a first insulating film having respective leading ends of said metal terminals mounted thereto;

a fusible alloy provided between said respective leading ends of said metal terminals;

a second insulating film provided over said fusible alloy, and affixed to said first insulating film; and metal layers provided at said respective leading ends of said metal terminals and connected to said fusible alloy, said metal layers having larger wettability to said fusible alloy than said metal terminals and said first insulating film, wherein an area (S) of said metal layers, a length (L1) and a volume (V) of said fusible alloy, a distance (L2) between said respective leading ends of said metal terminals, and a distance (d) from a bottom face of said second insulating film to a top face of said metal layers satisfy the relation:

$$Sd>\underline{V}(L1+L2)/2L1.$$

2. The thermal fuse of claim 1, wherein said metal terminals contain nickel, and said metal layers contain copper.

3. The thermal fuse of claim 1, wherein said metal terminals contain nickel, and said metal layers contain tin.

4. The thermal fuse of claim 1, further comprising a main body including said first insulating film, said second insulating film, and said fusible alloy, wherein a length of said main body ranges from 2.0 mm to 5.0 mm.

5. The thermal fuse of claim 1, wherein said distance from said bottom face of said first insulating film to said top face of said second insulating film ranges from 0.3 mm to 0.7 mm.

6. A thermal fuse comprising:

a pair of metal terminals;

a first insulating film having respective leading ends of said metal terminals disposed at a bottom face of said first insulating film exposed from a top face of said first insulating film;

a fusible alloy provided over said first insulating film and between said respective leading ends of said metal terminals;

a second insulating film provided over said fusible alloy, and affixed to said first insulating film; and metal layers provided at respective exposed portions of said metal terminals and connected to said fusible alloy, said metal layers having larger wettability to said fusible alloy than said metal terminals and said first insulating film, wherein an area (S) of said metal layers, a length (L1) and a volume (V) of said fusible alloy, a distance (L2) between said respective leading ends of said metal terminals, and a distance (d) from a bottom face of said second insulating film to said top face of said metal layers satisfy the relation:

$$Sd>V(L1+L2)/2L1.$$

7. The thermal fuse of claim 6, wherein said metal terminals contain nickel, and said metal layers contain copper.

8. The thermal fuse of claim 6, wherein said metal terminals contain nickel, and said metal layers contain tin.

9. The thermal fuse of claim 6, further comprising a main body including said first insulating film, said second insulating film, and said fusible alloy, wherein a length of said main body ranges from 2.0 mm to 5.0 mm.

10. The thermal fuse of claim 6, wherein said distance from said bottom face of said first insulating film to said top face of said second insulating film ranges from 0.3 mm to 0.7 mm.

* * * * *

UNITED STATES PATENT AND TRADEMARK OFFICE

CERTIFICATE OF CORRECTION

PATENT NO. : 7,068,141 B2
APPLICATION NO. : 10/468357
DATED : June 27, 2006
INVENTOR(S) : Kenji Senda et al.

It is certified that error appears in the above-identified patent and that said Letters Patent is hereby corrected as shown below:

In column 8, line 63, please replace "*Sd>V(L*1+*L2)/2L*1." with --Sd>V(L1+L2)/2L1.--.

Signed and Sealed this

Sixteenth Day of January, 2007

JON W. DUDAS
*Director of the United States Patent and Trademark Office*